US008253050B2

(12) United States Patent
Yamanaka

(10) Patent No.: US 8,253,050 B2
(45) Date of Patent: Aug. 28, 2012

(54) PUSH BUTTON SWITCH FOR ELECTRIC DEVICE

(75) Inventor: Takahito Yamanaka, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 165 days.

(21) Appl. No.: 12/763,196

(22) Filed: Apr. 19, 2010

(65) Prior Publication Data

US 2010/0270138 A1 Oct. 28, 2010

(30) Foreign Application Priority Data

Apr. 27, 2009 (JP) ..... 2009-107862

(51) Int. Cl.
*H01H 3/12* (2006.01)

(52) U.S. Cl. ..... 200/341

(58) Field of Classification Search ..... 200/341, 200/339, 238–239, 329–332.1, 86.5, 17 R
See application file for complete search history.

(56) References Cited

U.S. PATENT DOCUMENTS

| | | | | |
|---|---|---|---|---|
| 6,313,421 | B1 * | 11/2001 | Abrahamsen | 200/332.1 |
| 8,008,588 | B2 * | 8/2011 | Kaida et al. | 200/285 |
| 2008/0116048 | A1 * | 5/2008 | Straber et al. | 200/339 |

FOREIGN PATENT DOCUMENTS

| | | | |
|---|---|---|---|
| JP | S62-2132 | U | 1/1987 |
| JP | 2000-222970 | A | 8/2000 |
| JP | 2006-210220 | A | 8/2006 |

* cited by examiner

*Primary Examiner* — Edwin A. Leon
(74) *Attorney, Agent, or Firm* — Yokoi & Co., U.S.A., Inc.; Toshiyuki Yokoi

(57) ABSTRACT

When the assembly is complete, the protrusion 2*e* of the leaf spring 2*b* abuts against the bottom wall surface 3*g* which is an inner bottom surface of the cover member 3 and the leaf spring 2*b* is bent. Since the protrusion is pushed against the cover member 3, the leaf spring 2*b* generates force of repulsion which pushes the frame member 2*f* toward the opposite direction of the cover member 3. In addition, since the leaf springs 2*b* are aligned straightly between three bosses 3*b*, the leaf spring 2*b* pushes the push button 2 toward the switch board 1 almost in parallel. In other words, if the push button 2 is held in the cover member 3, without further components, the push button 2 is pushed against the switch board 1 and there will not be a possibility of a wobble.

7 Claims, 6 Drawing Sheets

PUSH BUTTON SWITCH FOR ELECTRIC DEVICE

CROSS-REFERENCES TO RELATED APPLICATIONS

The present invention contains subject matter related to and claims the benefit of Japanese Patent Application No. 2009-107862, filed in the Japan Patent Office on Apr. 27, 2009, the entire contents of which being incorporated herein by reference.

BACKGROUND OF THE INVENTION

1. Field of the Invention

This invention relates to a push button switch for electric devices.

2. Description of Related Art

In a conventional technology disclosed by Japanese Patent Laid-Open No. 2000-222,970 bulletin, a catching piece is formed on a main body of electric devices. And it engages with a protruding piece of a switch button frame and fixes the switch button frame.

The bulletin does not disclose relationship between a base board and a main body. Therefore, there was a possibility of wobble between the base board and the switch button frame.

In a conventional technology disclosed by Japanese Patent Laid-Open No. 2006-210,220 bulletin, a rubber button piece is aligned on a base board and a guide frame is pushed onto the rubber button piece toward the base board.

In this technology, since any covering pieces do not cover the switch base board, there was a problem that a special fixture would be necessary in order to prevent wobble.

In a conventional technology disclosed by Japanese Utility model Laid-Open No. 62-2132 bulletin, a frame for a push button is fixed by a lib.

The bulletin does not disclose relationship between a base board and a main body. Therefore, there was a possibility that wobble might be produced between the base board and the switch button frame.

BRIEF SUMMARY OF THE INVENTION

This invention provides a push button switch for electric devices that holds a push button piece made of resin in itself.

A push button switch of the invention comprises:

a switch board on which at least a push button switch element is placed;

a push button piece that is placed on the switch board, receives pushing movement and forwards the movement toward the push button switch element;

a cover member that holds the push button piece within the cover member and covers over the switch board; wherein, the push button piece abuts toward one of the switch board or the cover member, and generates force of repulsion against the other.

In the above configured push button switch, the push button piece being held in the cover member abuts toward one of the switch board or the cover member, and generates pressing power against the other.

Therefore, the push button piece will be kept in condition that it is pushed against either member in the cover member.

According to the above configured invention, since the push button piece will be kept in condition being pushed against one of the cover member or the switch board, there will not be a problem of wobble between the push button piece and the cover member or the switch board.

The other embodiment of the present invention is a push button switch wherein the push button piece is integrally made of resin with a button piece as an operating knob, a leaf spring that generates the force of repulsion, and a frame piece that connects the button piece and the leaf spring.

In the above configured invention, the button piece, the leaf spring and the frame piece are molded integrally with resin.

According to the invention, the push button piece can be provided by an easy integral molding.

The other embodiment of the present invention is a push button switch wherein both ends of the leaf spring are connected to the frame piece and has flexibility at center portion thereof, and the center portion has a protrusion that is shaped protruding as a shape of an arc.

In the above configured invention, having the both ends of the leaf spring be connected to the frame piece, the center portion of the leaf spring has flexibility, and having the center portion protrude as a shape of an arc, it will easily abut against an object with which the center portion will face and generate the force of repulsion against it.

According to the invention, the leaf spring can be easily molded integrally and without being a complicated shape.

The other embodiment of the present invention is a push button switch wherein the frame piece is equipped with a plurality of boss holes that are aligned straight with each other, the leaf spring is shaped between the boss holes, and the cover member is shaped to have bosses that pass through the boss holes and tips of the bosses are fixed onto the switch board with screws from backside of the switch board.

In the above configured invention, the bosses of the cover member pass through the boss holes of the push button piece and touch to the switch board, and further are fixed onto the switch board from backside of the switch board with screws.

Since the push button piece is penetrated with the bosses and positioned by them, and the leaf spring is located between the bosses, the leaf spring generates force of repulsion at the most stable position.

According to the invention, the leaf spring which supports the push button piece is located between the bosses, the force of repulsion will be generated at stable position, and the wobble will be prevented.

The other embodiment of the present invention is a push button switch wherein the cover member has a recess in which the switch board is held, and a rigid nail that engages with an edge of the switch board and an tilting nail that engages the switch board while being bent in accordance with the pushing movement of the switch board at the end position of the pushing movement are equipped inside the recess.

In the above configured invention, the cover member has a rigid nail. While engaging the edge of the switch board to the rigid nail, the switch board should be pushed into the cover member having the tilting nail be bent.

Then at the end position of the pushing movement, the tilting nail returns to the original position, and the rigid nail and the tilting nail catch the switch board.

The other embodiment of the present invention is a push button switch wherein the rigid nail is not bendable and protrudes toward inner direction from an inner wall surface of an opening edge of the cover member, the tilting nail is bendable and protrudes from bottom wall surface of the recess toward an opening of the cover member, and the leaf spring protrudes toward inner bottom surface of the cover member and pushes the push button piece toward the switch board.

In the above configured invention, since there is a rigid nail protruding toward inner direction at the opening edge of the cover member, the edge of the switch board can be engaged with the rigid nail.

On the other hand, since the tilting nail protrudes from bottom wall surface of the recess toward the opening of the cover member, when the switch board is pushed inside toward the tilting nail while being latched with the rigid nail, the switch board gets into the cover member while having the tilting nail be bent.

Then the tilting nail returns at the end position of the pushing movement, thus the tilting nail and the rigid nail catch the switch board tightly.

The other embodiment of the present invention is a push button switch wherein the push button piece is made of resin integrally with a button piece as an operating knob, a leaf spring that generates force of repulsion, and a frame piece that connects the button piece and the leaf spring; the frame piece is equipped with a plurality of boss holes that are aligned straight with each other, the leaf spring has flexibility at center portion by connecting both ends of the leaf spring to the frame piece, and the center portion has a protruding portion that is configured to protrude as a shape of an arc; the cover member is shaped to have bosses that pass through the boss holes and tips of the bosses are fixed onto the switch board with screws from backside of the switch board; the cover member has a recess in which the switch board is held; and inside the recess are equipped with a rigid nail that protrudes toward inner direction from an inner wall surface of an opening edge of the cover member and latches with the edge of the switch board, and a bendable tilting nail that protrudes from bottom wall surface of the recess toward an opening of the cover member and inclines while the switch board is pushed into and returns at the end position of the pushing movement.

According to this invention, it provides merits as described above.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Hereinafter, a first embodiment of the present invention will be described with referent to the drawings.

Figure 1:
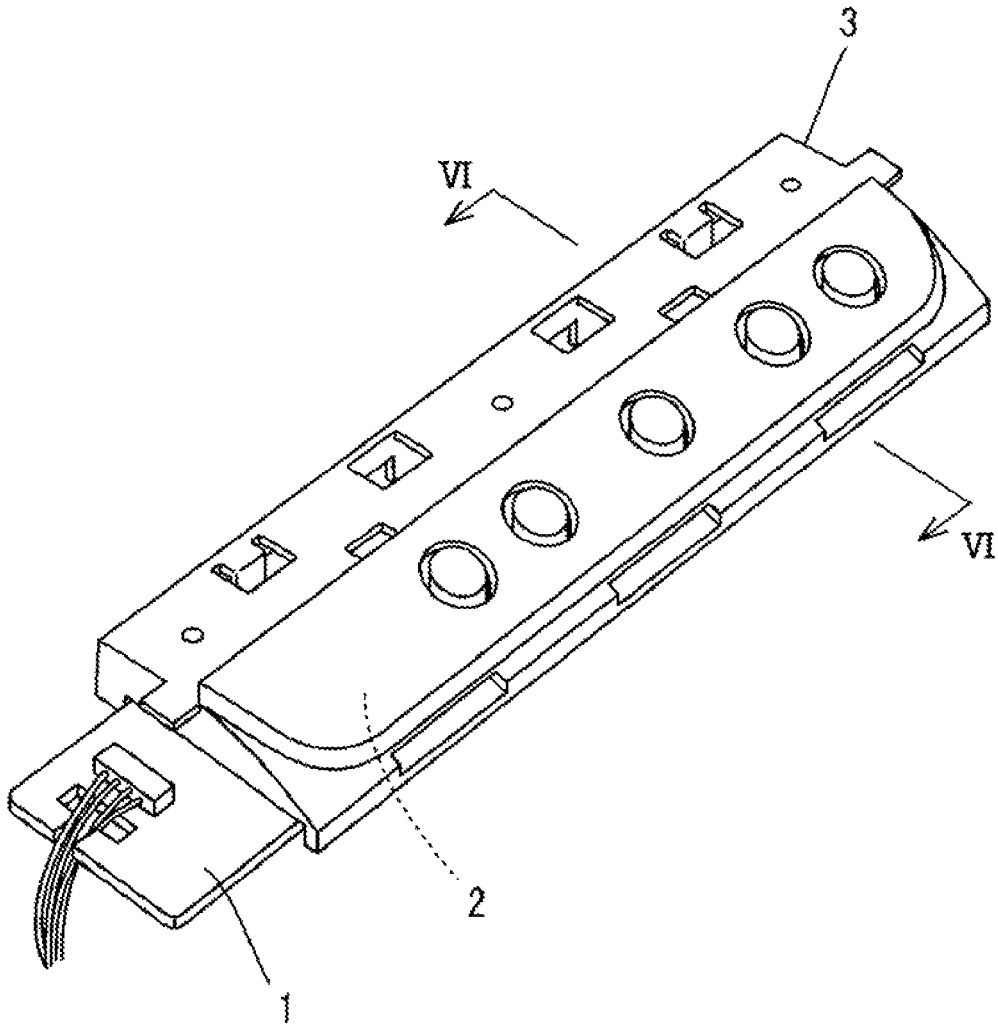
FIG. 1 shows a perspective view illustrating the assembled push button switch for electric devices according to a first embodiment of the present invention.
Figure 2:
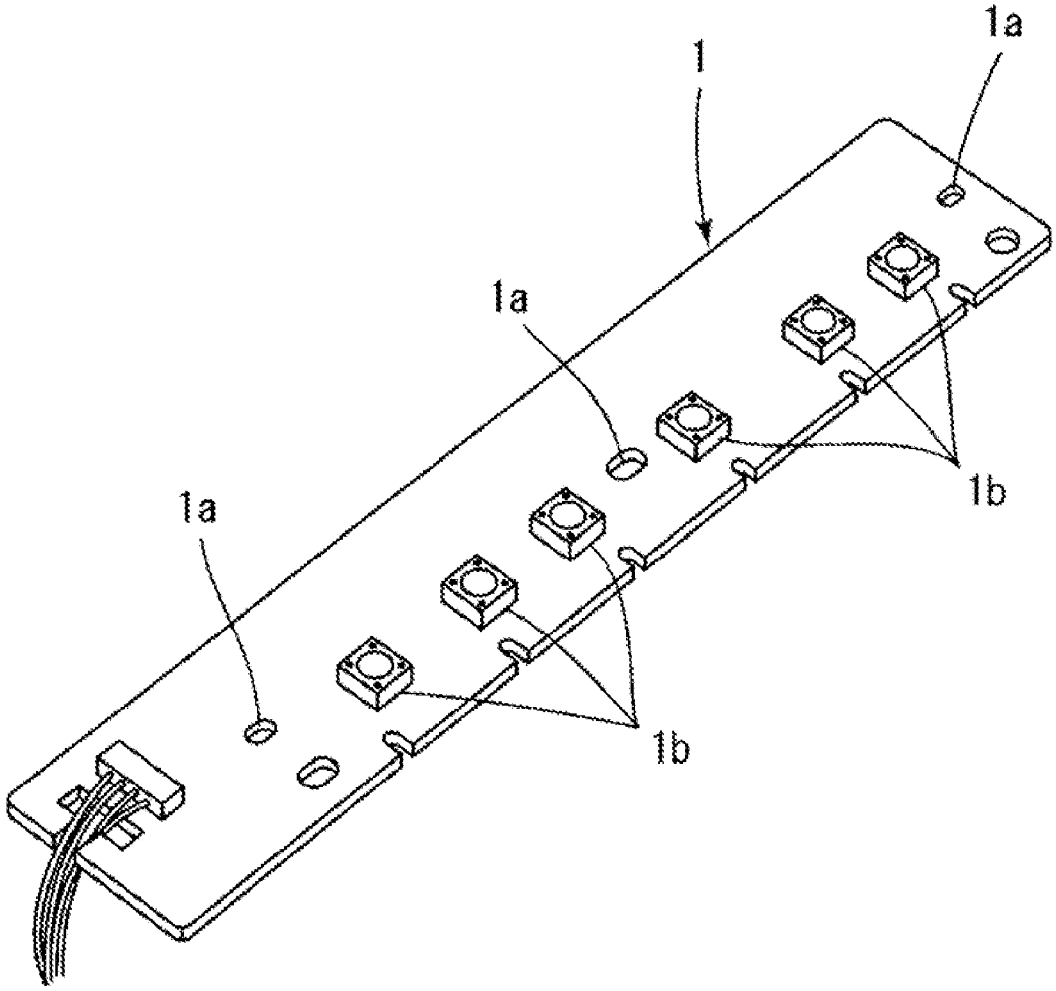
FIG. 2 shows a perspective view of the switch board according to a first embodiment of the present invention.
Figure 3:
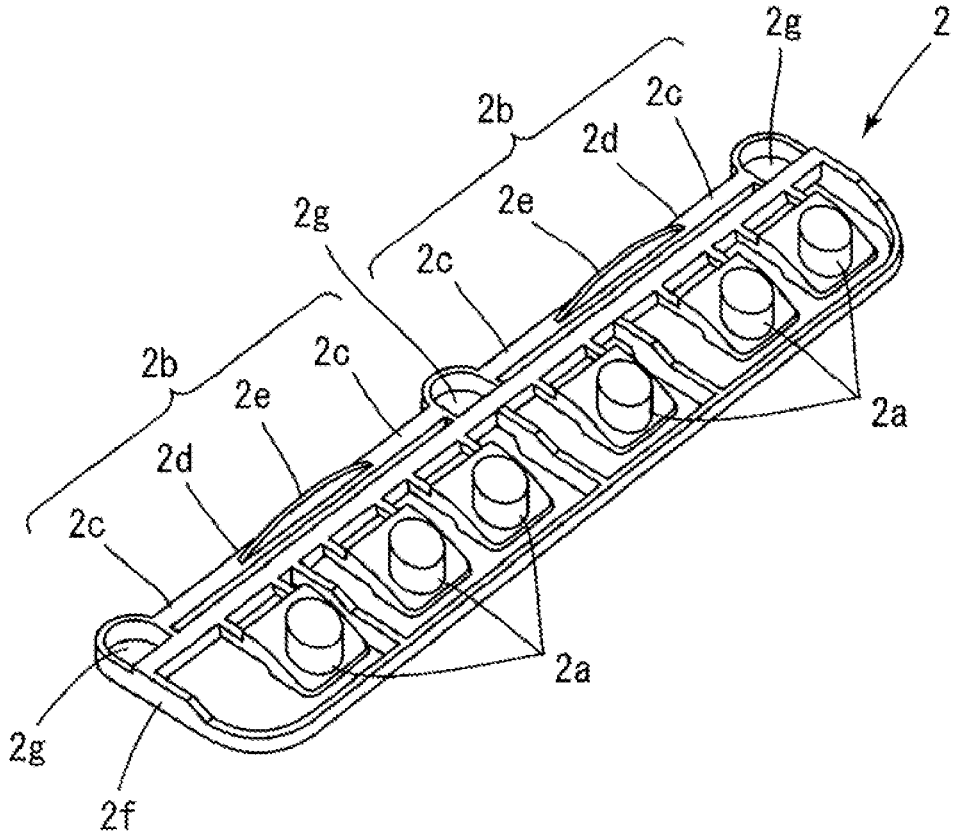
FIG. 3 shows a perspective view of the push button piece according to a first embodiment of the present invention.
Figure 4:
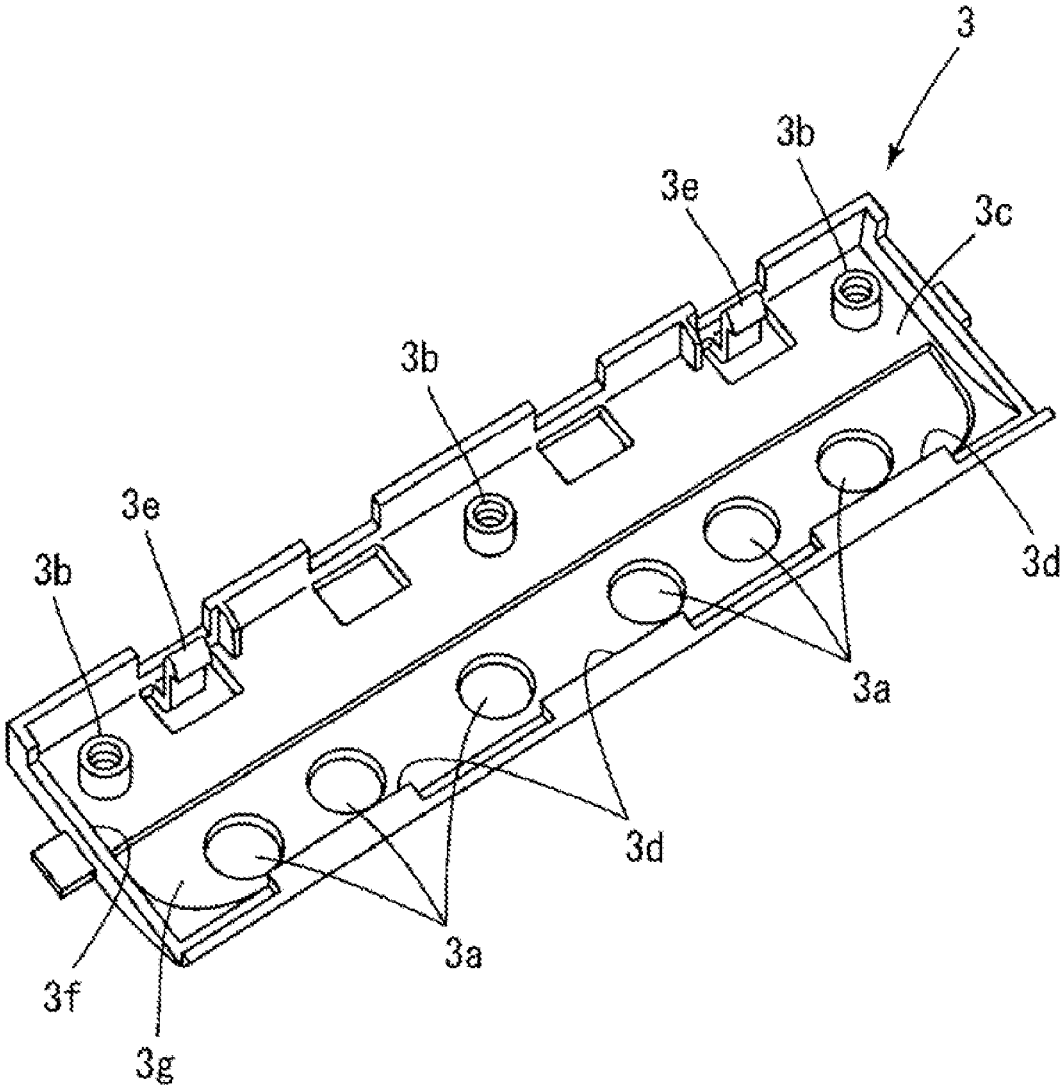
FIG. 4 shows a perspective view of the cover member according to a first embodiment of the present invention.

FIG. 1 shows a perspective view illustrating the assembled push button switch for electric devices according to a first embodiment of the present invention. FIG. 2 shows a perspective view of the switch board according to a first embodiment of the present invention. FIG. 3 shows a perspective view of the push button piece according to a first embodiment of the present invention. FIG. 4 shows a perspective view of the cover member according to a first embodiment of the present invention.

The push button switch for electric devices comprises a switch board 1, a push button piece 2, and a cover member 3.

The push button switch is assembled as follows. The push button piece 2 is placed on the switch board 1. Then the cover member 3 is placed on them to cover them, and is fixed to the switch board 1.

Further detailed components are explained hereinafter.

FIG. 2 shows the switch board 1, a screw hole 1*a*, and a push button switch element 1*b*.

The switch board 1 is a print circuit board on which a plurality of switch elements 1*b* are placed and electrically connected. Six push button switch elements are placed on one side that is an opposite side of the print circuit. And the push button switch elements 1*b* are electrically connected on the opposite side.

In addition, the switch board 1 is formed in the shape of a strip. A plurality of notches are formed on one of the longer side. On the contrary, no notches are formed on the other side of the longer side.

In addition, three screw holes 1*a* are formed on the switch board 1 in order to be fixed with screws as described in later.

Each push button switch elements 1*b* is a switch element that changes the status of contact between on and off in correspondence with pushing operation.

FIG. 3 shows a push button piece 2, a button piece 2*a*, a leaf spring 2*b*, an end portion 2*c*, a central portion 2*d*, a protrusion 2*e*, a frame member 2*f*, and a boss hole 2*g*.

The push button piece 2 is integrally made of resin, and forwards human pushing operation toward the push button switch element 1*b* on the switch board 1.

The button piece 2*a* is an operating knob, and is held by a thin elastic portion. The button piece 2*a* can be inclined by human pushing operation, and forwards the operation toward the movable portion of the push button switch element 1*b*.

The leaf spring 2*b* operates as a spring by generating force of repulsion against bending movement.

Both of end portion 2*c* are portions that connect the leaf spring 2*b* with the push button piece 2 at the both ends of the leaf spring 2*b*. And the central portion 2*d* is a central portion of the leaf spring 2*b*.

The protrusion 2*e* is an arc shaped portion that protrudes from the leaf spring 2*b*.

The frame member 2*f* supports the button piece 2*a*. Since the button piece 2*a* is connected with the frame member 2*f* by a thin portion, the button piece 2*a* is held with bendable character.

The boss holes 2*g* are holes to align and hold bosses 3*b* by having the bosses 3*b* pass through. And the boss holes 2*g* are aligned straight.

FIG. 4 shows a cover member 3, a button hole 3*a*, a boss 3*b*, a recess 3*c*, a rigid nail 3*d*, a tilting nail 3*e*, an opening edge 3*f*, a bottom wall surface 3*g*.

The cover member 3 is a member in which the push button piece 2 is held. The cover member 3 covers and fixes the switch board 1.

The button hole 3*a* is an opening for having the button piece 2*a* that is held inside the cover member 3 be exposed to outside in order to be manipulable.

The boss 3*b* is shaped as a short pillar shape. And the boss 3*b* can be fixed to the backside of the switch board 1 by a screw that passes through the screw hole 1*a*.

The recess 3*c* is a dent portion that is shaped as a shallow rectangular open box and capable of holding the push button piece 2.

The rigid nail 3*d* is a protruding portion that protrudes toward inner direction and is capable of engaging with one edge of the switch board 1.

In addition, a plurality of notches are made along one edge of the switch board 1. And the rigid nail 3*d* is formed at places where correspond between the notches.

The tilting nail 3*e* has an elasticity and protrudes from inner wall surface of the recess 3*c* toward an opening of the recess 3*c* in order to be capable of engaging with the edge of the switch board 1. And the tip of the tilting nail 3*e* is an engaging piece that protrudes toward the rigid nail 3*d*.

While engaging the edge of the longer side of the switch board 1 with the rigid nail 3*d*, when the other edge of the longer side is pushed to the tilting nail 3*e*, the other edge abuts to the tilting nail 3*e* and bends the tilting nail 3*e* to move away from the rigid nail 3*d*.

When the switch board 1 is pushed further inside, since it passes engaging portion of the tilting nail 3*e*, the tilting nail 3*e* returns to the original position and engages with the edge of the switch board 1.

This is the end position of the pushing movement.

The opening edge 3*f* is an opening portion of the cover member 3 that is shaped as a shallow rectangular open box. And the bottom wall surface 3*g* is an inner bottom surface of the cover member 3.

Figure 5:
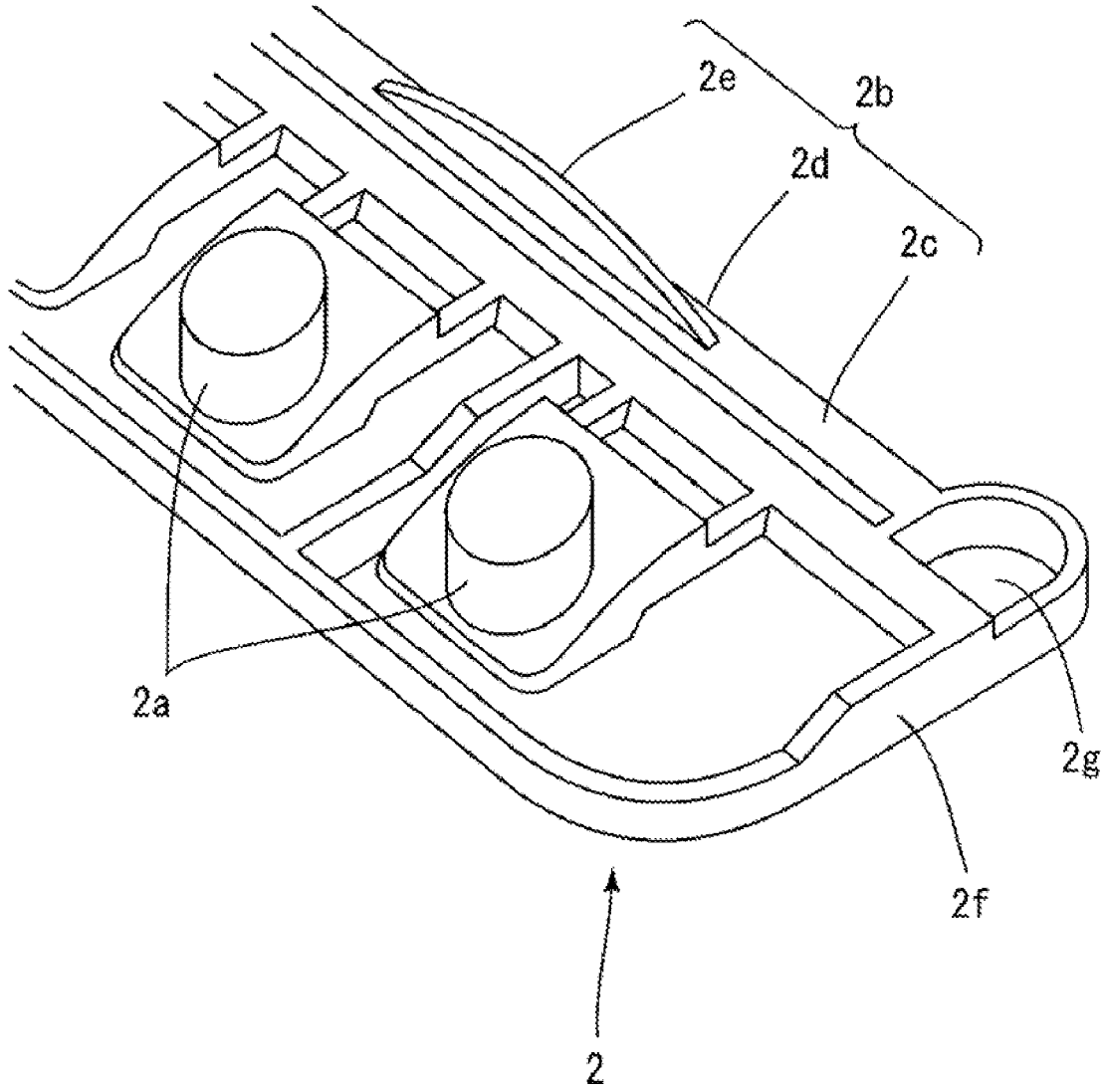
FIG. 5 shows an enlarged perspective view of the leaf spring according to a first embodiment of the present invention.

FIG. 5 is an enlarged perspective view of the leaf spring.

FIG. 5 shows a push button piece 2, a button piece 2*a*, a leaf spring 2*b*, an end portion 2*c*, a central portion 2*d*, a protrusion 2*e*, a frame member 2*f*, and a boss hole 2*g*.

The leaf spring 2*b* connects to the frame member 2*f* with both end portions 2*c*, 2*c* as mentioned above.

Since the leaf spring 2*b* is made of resin, even though the leaf spring 2*b* is connected with the frame member 2*f*, the leaf spring 2*b* has enough flexibility and still functions as a spring member.

Further, the protrusion 2*e* that protrudes in the shape of an arc protrudes in a same direction of the button piece 2*a* as shown in the figure.

The method to assemble the push button switch for electric device will be explained as follows.

Figure 6:
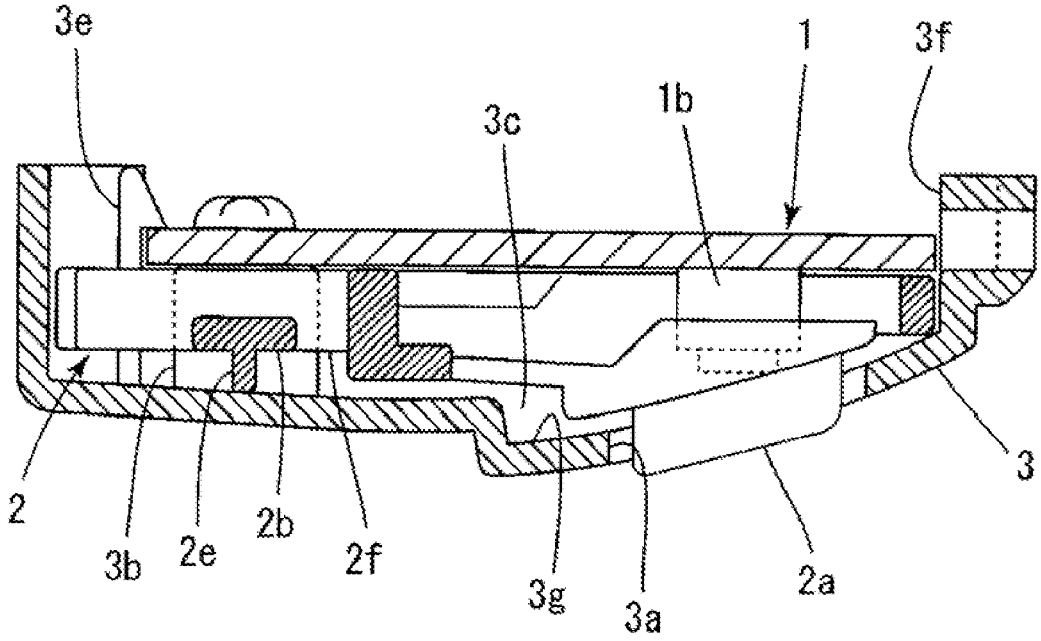
FIG. 6 shows a cross sectional view of the assembled push button switch for electric devices.

FIG. 6 is a cross sectional view of the assembled push button switch for electric devices. The figure shows a switch board 1, a push button switch element 1*b*, a push button piece 2, a button piece 2*a*, a leaf spring 2*b*, a protrusion 2*e*, a frame member 2*f*, a cover member 3, a button hole 3*a*, a boss 3*b*, a recess 3*c*, a tilting nail 3*e*, an opening edge 3*f*, and a bottom wall surface 3*g*.

In order to assemble the push button switch, the cover member 3 is turned to face the opening of the recess 3*c* upward, and the push button piece 2 is put into the recess 3*c*.

The button piece 2*a* of the push button 2 is aligned to get into the button hole 3*a* of the cover member 3, and three bosses 3*b* of the cover member 3 are placed to get into boss holes 2*g* of the push button piece 2.

The push button piece 2 is aligned by having the boss 3*b* get into the boss holes 2*g*.

Then the edge of the switch board 1 that is one of the longer side of the switch board 1 is put inside the rigid nail 3*d* of the cover member 3. And the switch board 1 is engaged with the rigid nail 3*d*.

Then the other edge of the switch board 1 that is another side of the longer side of the switch board 1 will be pushed toward the tilting nail 3*e*.

At this time, the push button switch element 1*b* will be get into the backside of the button piece 2*a* of the push button piece 2.

When the switch board 1 is furthermore pushed toward the cover member 3, another edge of the switch board 1 abuts to the engaging piece that is a tip of the tilting nail 3*e*, and bends the tilting nail 3*e* toward the opposite direction of the rigid nail 3*d*.

When the switch board 1 is pushed into a place where it abuts to the boss 3*b*, the switch board 1 passes over the peak of the engaging piece that is a tip of the tilting nail 3*d*, the tilting nail 3*e* returns to the original position and the engaging piece engages with the backside of the switch board 1.

Then the switch board 1 will not be removed from the cover member 3.

After that, a screw that passes through the screw hole 1*a* fixes the switch board 1 and the cover member 3 together.

By the way, when the assembling is complete, the protrusion 2*e* of the leaf spring 2*b* abuts to the bottom wall surface 3*g* that is an inner bottom surface of the cover member 3 and thus the leaf spring 2*b* is bent.

When the protrusion 2*e* is pushed toward the cover member 3, the leaf spring 2*b* generates force of repulsion that forces the frame member 2*f* toward the opposite direction of the cover member 3.

In addition, since the leaf springs 2*b* are aligned straight between three bosses 3*b*, the leaf spring 2*b* push the push button piece 2 toward the switch board 1 almost in parallel.

In other words, if the push button piece 2 is held in the cover member 3, without further components, the push button piece 2 is pushed against the switch board 1 and there will not be a possibility of wobble.

In addition, in order to generate force of repulsion, the protrusion 2*e* can be placed to protrude toward the switch board 1.

In this case, since the protrusion 2*e* abuts to the switch board 1 when the push button switch is assembled, the push button piece 2 abuts to the cover member 3 and there will not be a possibility of a wobble.

In other words, when the protrusion 2*e* abuts with one of the switch board 1 or the cover member 3, the protrusion 2*e* generates force of repulsion against the other one.

In the above mentioned embodiment, the leaf spring 2*b* is connected to the frame member 2*f* at the both ends thereof. However, it can be connected with other method such as with only one end in order to be a spring member.

In addition, in the above mentioned embodiment, the cover member 3 is an independent component. However, it can be a portion of the cabinet of a television set.

In this case, the push button piece will receive force of repulsion toward one of the cabinet and the switch board, thus there will not be possibility of wobble.

The correspondence between the component of the claimed invention and the exemplary component in the embodiment will be explained below.

The switch board in the claim comprises of the switch board 1, a screw hole 1*a*, and the push button switch element 1*b*.

The push button piece in the claim comprises of the push button piece 2, the button piece 2*a*, the leaf spring 2*b*, both ends 2*c*, the central portion 2*d*, the protrusion 2*e*, the frame member 2*f*, and the boss hole 2*g*.

The cover member in the claim comprises the cover member 3, the button hole 3*a*, the boss 3*b*, the recess 3*c*, the rigid nail 3*d*, the tilting nail 3*e*, the opening edge 3*f*, and the bottom wall surface 3*g*.

The leaf spring in the claim comprises of the leaf spring 2*b*.

The frame member in the claim comprises the frame member 2*f*.

The rigid nail in the claim comprises the rigid nail 3*d*.

The tilting nail in the claim comprises of the tilting nail 3*e*.

In addition, it goes without saying that it is not the thing that this invention is limited to the embodiment mentioned above.

This invention is not limited to the embodiment mentioned above. And following are also disclosed in this specification; namely, changing a combination of mutually substitutable members and structures disclosed in the above embodiments as necessary;

replacing and changing members or a combination of the members with well-known technology which is not disclosed in the above embodiments and is mutually substitutable with the members; and replacing and changing members or a combination of the members with the members or structures which an ordinary skilled person could substitute with the members disclosed in the above embodiments based on prior arts.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

In addition, reference to "first," "second," "third," and etc. members throughout the disclosure (and in particular, claims) is not used to show a serial or numerical limitation but instead is used to distinguish or identify the various members of the group.

What is claimed is:

1. A push button switch, comprising:

a switch board on which at least a push button switch element is placed;

a push button piece that is placed on the switch board, receives pushing movement and forward the movement toward the push button switch element;

a cover member that holds the push button piece within the cover member and covers over the switch board; wherein, the push button piece is equipped with a protrusion which abuts toward one of the switch board or the cover member once after an assembling of the push button into the switch board and the cover member is completed, and generates force of repulsion against the other while the push button piece is held in the cover member and the cover member.

2. A push button switch of claim 1, wherein the push button piece is integrally made of resin with a button piece as an operating knob, a leaf spring that generates the force of repulsion, and a frame piece that connects the button piece and the leaf spring.

3. A push button switch of claim 2, wherein both ends of the leaf spring are connected to the frame piece and has flexibility at center portion thereof, and the center portion has a protrusion that is shaped protruding as a shape of an arc.

4. A push button switch of claim 3, wherein the frame piece is equipped with a plurality of boss holes that are aligned straight with each other, the leaf spring is shaped between the boss holes, and the cover member is shaped to have bosses that pass through the boss holes and tips of the bosses are fixed onto the switch board with screws from backside of the switch board.

5. A push button switch of claim 1, wherein the cover member has a recess in which the switch board is held, and a rigid nail that engages with an edge of the switch board and an tilting nail that engages the switch board while being bent in accordance with the pushing movement of the switch board at the end position of the pushing movement are equipped inside the recess.

6. A push button switch of claim 5, wherein the rigid nail is not bendable and protrudes toward inner direction from an inner wall surface of an opening edge of the cover member, the tilting nail is bendable and protrudes from bottom wall surface of the recess toward an opening of the cover member, and the leaf spring protrudes toward inner bottom surface of the cover member and pushes the push button piece toward the switch board.

7. A push button switch of claim 1, wherein the push button piece is made of resin integrally with a button piece as an operating knob, a leaf spring that generates force of repulsion, and a frame piece that connects the button piece and the leaf spring; the frame piece is equipped with a plurality of boss holes that are aligned straight with each other, the leaf spring has flexibility at center portion by connecting both ends of the leaf spring to the frame piece, and the center portion has a protruding portion that is configured to protrude as a shape of an arc; the cover member is shaped to have bosses that pass through the boss holes and tips of the bosses are fixed onto the switch board with screws from backside of the switch board; the cover member has a recess in which the switch board is held; and inside the recess are equipped with a rigid nail that protrudes toward inner direction from an inner wall surface of an opening edge of the cover member and latches with the edge of the switch board, and a bendable tilting nail that protrudes from bottom wall surface of the recess toward an opening of the cover member and inclines while the switch board is pushed into and returns at the end position of the pushing movement.

* * * * *